United States Patent [19]

Lehmann et al.

[11] 4,169,564

[45] Oct. 2, 1979

[54] YARN GUIDE FOR USE IN WINDING YARN ON A PACKAGE

[75] Inventors: Karl-Heinz Lehmann; Peter Artzt, both of Pfullingen, Fed. Rep. of Germany

[73] Assignee: Schubert & Salzer, Ingolstadt, Fed. Rep. of Germany

[21] Appl. No.: 819,481

[22] Filed: Jul. 27, 1977

[30] Foreign Application Priority Data

Jul. 30, 1976 [DE] Fed. Rep. of Germany ..... 2634251

[51] Int. Cl.[2] ..... B65H 57/00; B65H 57/26; B65H 59/36

[52] U.S. Cl. ..... 242/157 R; 242/18 DD; 242/43 R; 242/45; 242/147 R; 242/154

[58] Field of Search ..... 242/147 R, 153, 154, 242/45, 18 DD, 18 PW, 43 R, 76, 75.2, 75.3, 149, 157.1

[56] References Cited

U.S. PATENT DOCUMENTS

| | | | |
|---|---|---|---|
| 1,303,320 | 5/1919 | Houghton | 242/154 |
| 1,602,447 | 10/1926 | Olson | 242/154 |
| 2,323,987 | 7/1943 | Foster | 242/147 R |
| 2,855,163 | 10/1958 | Powers | 242/157.1 |
| 2,924,957 | 2/1960 | Schoenster | 242/147 R X |
| 3,129,902 | 4/1964 | Juillard | 242/149 |
| 3,188,713 | 6/1965 | Dyer et al. | 242/147 R X |
| 3,974,972 | 8/1976 | Egli et al. | 242/18 PW |

*Primary Examiner*—Stanley N. Gilreath
*Attorney, Agent, or Firm*—Bailey, Dority & Flint

[57] ABSTRACT

A device for guiding yarn as it is wound on a package from a source at a constant speed. The yarn passes over a yarn guide member which is supported on a holder. The holder is resiliently supported transversely to the direction of the yarn travel through the guide member for compensating for changes of the yarn tension during winding of the yarn onto the package.

5 Claims, 5 Drawing Figures

30
3
4
2
F
6
5
10
1

YARN GUIDE FOR USE IN WINDING YARN ON A PACKAGE

BACKGROUND OF THE INVENTION

The present invention relates to a device for winding a yarn supplied at a constant speed on a bobbin having a yarn guide member.

In general, it is customary to wind the yarn supplied at a constant speed from a textile machine, such as, for example, an open-end spinning machine, directly after its formation in the spinning chamber into a cylindrical or conical cross-wound bobbin. Hereby, the bobbin holder, i.e. the bobbin to be formed upon it, is in frictional contact with a drive shaft and is set in rotation by the same while the yarn is subjected to a to-and-fro movement along the width of the bobbin. This to-and-fro movement changes the length of the yarn passage from the yarn supply point to the yarn wind-up point, whereby constant yarn supply speeds results in different yarn tensions.

In order to compensate for the deviating yarn tensions caused by the changing lengths of the yarn, it has already been suggested to pass the yarn over a rigid yarn guide member having a convex curve (U.S. Pat. No. 3,690,576) arranged between the yarn supply point and the to-and-fro mechanism. This, however, does make it possible to equalize the length of the yarn passage and to compensate for the changes in yarn tension caused by the different lengths of the passages. However, the yarn tension is not only dependent upon the length of the yarn passage, but also on the dynamic yarn stresses produced during the winding process and the frictional relationships at the yarn guide member.

Since the yarn winding speed is the result of the circumferential speed of the winding point and the speed of the to-and-fro movement, when the to-and-fro movement at the reversing point practically sinks to zero, there takes place a temporary change in the winding speed and, therefore, high amplitude changes in the dynamic yarn tension at the reversing point. Furthermore, as a result of the directional changes high accelerating forces act upon the yarn at the reversing point. These changes in the yarn tension result in faults occurring during the formation of yarn packages on the bobbins. The known type of rigid yarn guide is unable to equalize such dynamic yarn tensions just as it is unable to compensate for the changes in yarn tension produced during the formation of conical bobbins. In the formation of conical bobbins, the tensions are produced as a result of the fact that the percentage change in the wind-up speed from a small to a large diameter is greater at the beginning and drops with increasing diameter.

Problems arise especially during the winding of yarns supplied at a constant speed from an open-end rotary spinning machine since during the supply of yarn from the rotor, the yarn is subjected to a medium tension which stretches the yarn by a specific amount and, subsequently, releases it in a wind-up zone. Depending on the type of fibers, yarn number, and yarn twist, different relaxation forces are produced which may deviate within a bobbin also during the spinning and winding process. This means that a yarn which is passed over the known type of yarn guide member is wound onto a bobbin at varying yarn tension (pretension), which at the subsequent dyeing stage may lead to differences in the color of the yarn.

SUMMARY OF THE INVENTION

In one embodiment of the invention, a yarn guide member is carried by resilient mounting members which are leaf springs acting as a double spring. The soft springing action of the leaf springs is ensured by joining together the ends of the leaf springs by means of elastic members. This produces an economical system for ensuring stability to the yarn guide member. In another embodiment, the resilient mounting is formed by pressure springs or it is formed by a yarn guide member supporting rail made of a resilient material and which is connected by a bar with a holding rail acting as the retaining means. In the latter case, it is advantageous to manufacture the supporting rail with the bar and the holding rail in one piece. The production of conical cross-wound bobbins is facilitated in that the bar is arranged off-center to the yarn guide member.

Accordingly, it is an object of the present invention to provide a yarn guide which compensates in changes of the yarn tension and maximum yarn tensions during winding of the yarn onto a bobbin.

Another important object of the present invention is to resiliently support the yarn guide member transversely to the direction of the yarn so that the yarn guide member and yarn passing therethrough moves to compensate for changes in the tension in the yarn as it is wound on a bobbin.

These and other objects and advantages of the invention will become apparent upon reference to the following specification, attendant claims, and drawing.

DESCRIPTION OF THE PREFERRED EMBODIMENT

Figure 1:
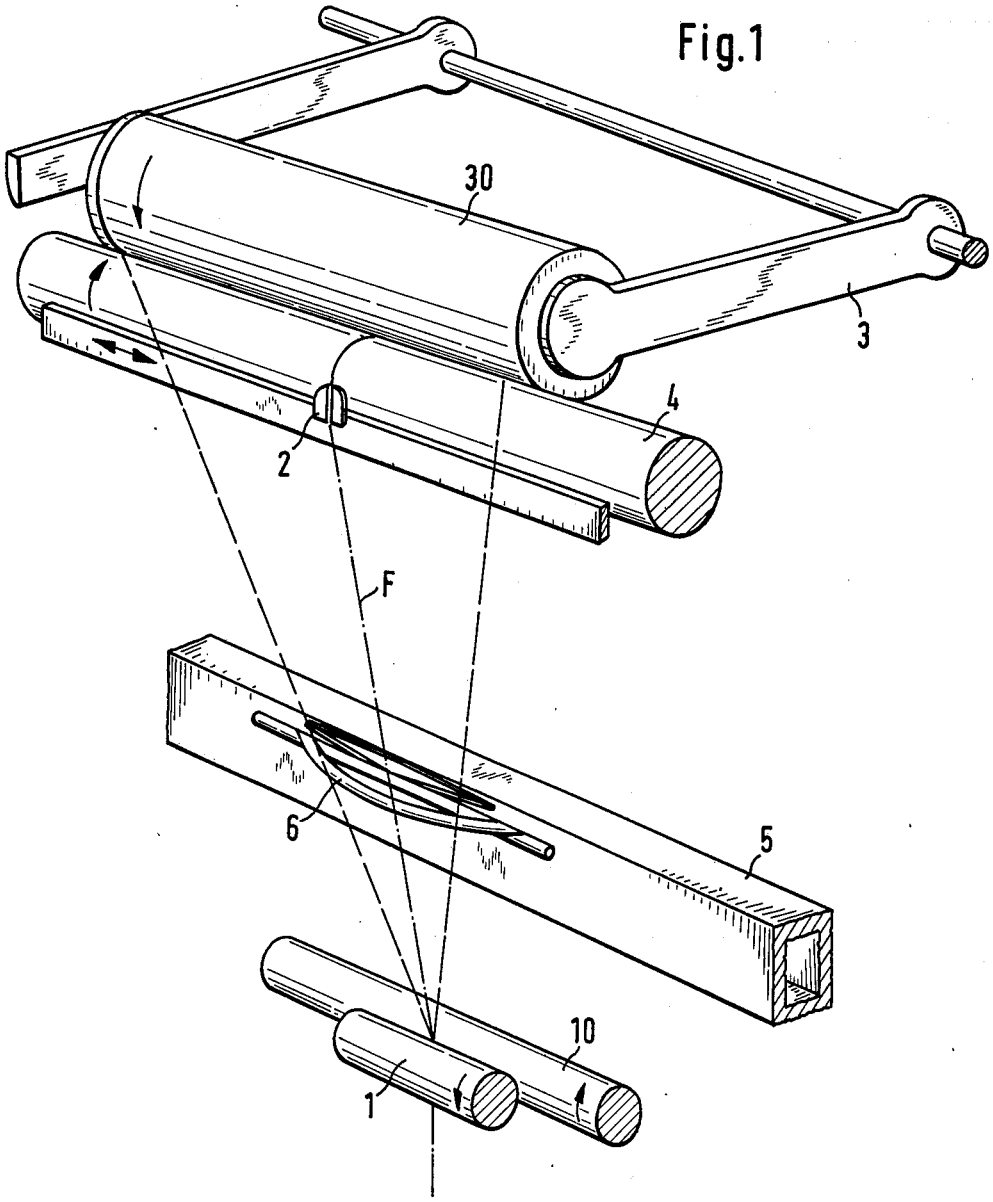
FIG. 1 is a perspective view illustrating a portion of a winding device utilizing a yarn guide constructed in accordance with the present invention.

According to FIG. 1, a yarn F being supplied at a constant speed, in this case, from an open-end rotary spinning machine (not shown), is continuously taken off by a pair of take-up rollers 1 and 10 and by means of a to-and-fro moving yarn guide 2 wound onto a bobbin former 30 held by a bobbin holder 3 to form a cylindrical or even conical cross-over bobbin. The bobbin former 30 is arranged in contact with a driven roller 4 and is frictionally rotated by it.

Between the take-up rollers 1 and 10 and the yarn guide member 2, a yarn guide member 6 is fixed to a longitudinal part 5 of the machine, in this case, a suction duct, over which passes the yarn F. The yarn guide member 6 is convexly curved towards the yarn F, its shape being predetermined in response to the change in length of the yarn passage between the take-up rollers 1 and 10 and the winding point, as a result of the to-and-fro movement of the yarn F. The yarn guide member 6 is, therefore, able to compensate for the changes in the yarn length during winding and the changes in yarn tension associated therewith as a result of the geometric yarn triangle (broken lines).

Furthermore, contrary to known embodiments, the yarn guide member 6 according to this invention is resiliently mounted in its holder transversely to the direction of yarn travel F, whereby either the longitudinal part 5 itself can form the holder, or more suitably a holding rail 61 (FIGS. 2 to 5) can be used as the holder which is then fixed to the longitudinal part 5 in a suitable manner.

As a result of the resilient mounting of the yarn guide member 6, to be described in more detail later, the changes in yarn tension as a result of dynamic yarn stresses during winding are effectively compensated. Thus, for example, particularly maximum yarn tensions which are produced at the reversing points of the yarn guide member 2 and which result in yarn slipping off the bobbin, are compensated in that the yarn guide member 6 resiliently gives way to the stronger pressure of the yarn F acting upon it. By using special drives, by means of which pattern windings on a bobbin are prevented, in that the to-and-fro moving yarn guide member 2 is adapted to make more rapid to-and-fro movements in the end regions of the bobbin, the resilient arrangement of the yarn guide member 6 ensures length compensation at constant yarn tension. Furthermore, the resiliently mounted yarn guide member 6 also facilitates the unimpeded winding of conical bobbins, production of which at a constant yarn supply speed is particularly difficult because on each side of the bobbin there are wound different lengths of the yarn F.

Figure 2:
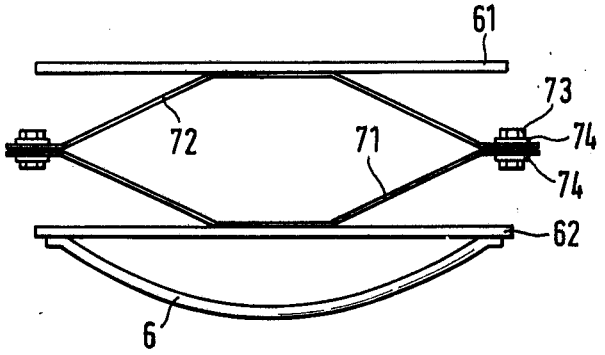
FIG. 2 is an enlarged plan view illustrating one type of yarn guide device constructed in accordance with the present invention.

The resilient mounting of the yarn guide member 6 can be effected in different ways. FIG. 2 shows an example of an embodiment in which the yarn guide member 6, fixed to a supporting rail 62, is resiliently mounted transverse to the yarn passage by means of two double arm leaf springs 71 and 72, one fixed to the supporting rail 62 and the other to the holding rail 61. The arms of leaf springs 71 and 72 extending away from the supporting rail 62 and holding rail 61 in this arrangement form the arms of a triangle and are connected at their ends by screws 73, etc. In view of the fact that the mounting must be very resilient, it is preferable to provide suitable elastic elements 74, preferably rubber discs, at the connection points between the free ends of the leaf springs 71 and 72.

Naturally, it is possible instead of the two double-arm leaf spring 71 and 72 to have four one-arm leaf springs in order to obtain the double spring arrangement depicted.

Figure 3:
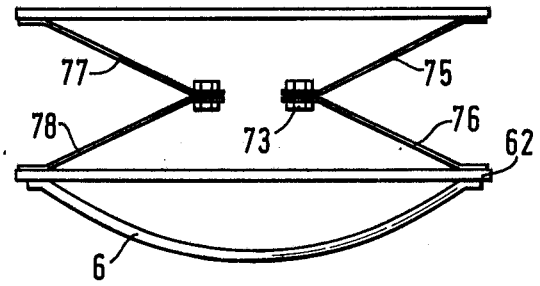
FIG. 3 is a plan view illustrating still another type of yarn guide device constructed in accordance with the present invention.

FIG. 3 shows the yarn guide member 6 as a double spring with four one-arm leaf springs 75, 76, 77 and 78, which are each attached to the ends of the holding rail 61 and the supporting rail 62 and extend inwardly from the rail so that the connecting points of two leaf springs always face each other. The connection of the leaf springs 75 and 76 on the one hand, and that of the leaf springs 77 and 78 on the other hand, in this case also is achieved by screws 73, preferably also by using elastic members 74, as in FIG. 2.

The use of leaf springs as the resilient supporting members for the yarn guide member 6 as in FIGS. 2 and 3, apart from the simple and economical manufacture, also has a number of other advantages. These consist in the fact that in any spring position the center point of the yarn guide member 6 retains its central position, i.e. the yarn guide member is always in a working position and the spring tension responds readily, a feature of particular significance at high yarn speeds. Also, the stability of the device in the direction of yarn travel is ensured.

If necessary, this can be increased still further by using wider or less resilient leaf springs whereby a soft spring action is still achieved by the use of elastic members 74 at the connecting points of the springs.

Figure 4:
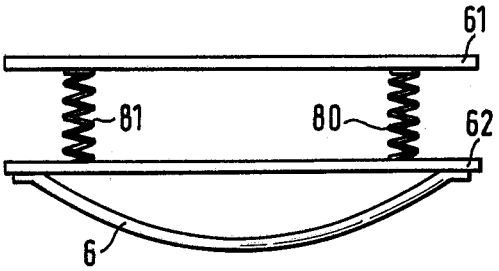
FIG. 4 is a plan view illustrating still another embodiment of the yarn guiding device constructed in accordance with the present invention.

In the example of FIG. 4, the resilient mounting of yarn guide member 6 transversely to the direction of yarn travel is formed by pressure springs 80 and 81 which are connected near the ends of the holding rail 61 and supporting rail 62.

Figure 5:
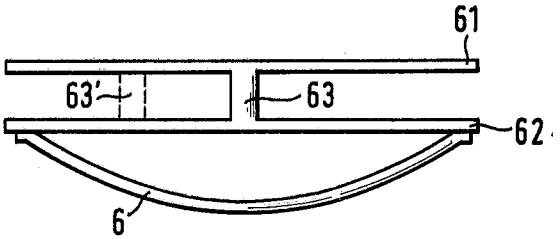
FIG. 5 is a plan view illustrating still another embodiment of a yarn guiding device constructed in accordance with the present invention.

A further way of resiliently mounting the yarn guide member 6 transversely to the direction of yarn travel F includes constructing the supporting rail 62 from an elastic material which is connected to the holding rail by means of a bar 63 arranged centrally to the yarn guide member 6 (FIG. 5). The bar 63 can be made as a separate part and fixed to both rails. However, it is more practical if the supporting rail 62 with the holding rail 61 and bar 63 are made of one piece (as shown). For producing conical crosswound bobbins, in place of the bar 63 arranged centrally to the yarn guide member 6, there is provided a bar 63' situated off-center to the yarn guide member 6.

Apart from those described above, there are other solutions for achieving a resilient mounting of the yarn guide member 6 transversely to the direction of yarn travel F. For example, it is possible for suspending the yarn guide member 6 on at least one spiral spring extending in the direction of yarn travel F, or a pneumatic cushioning device may be used for the yarn guide member 6.

The type of yarn tension compensation described above is not limited to the embodiment shown, but in principle can also be effected when the yarn guide member is arranged in a position which is not parallel to the bobbin axis. The only essential thing is that the pressure exerted by the yarn on the yarn guide member is elastically absorbed.

The invention is shown in an example with a to-and-fro moving yarn guide. However, the invention may be used with particular advantage in connection with a winding device in which the yarn displacement takes place by means of a slotted cylinder, grooved cylinder or flyer type of yarn guide.

While a preferred embodiment of the invention has been described using specific terms, such description is for illustrative purposes only, and it is to be understood that changes and variations may be made without departing from the spirit or scope of the following claims.

What is claimed is:

1. A device for guiding yarn as it is wound on a package from a source at a constant speed comprising:

an elongated yarn guide member over which said yarn passes as it is fed from said source to said package;

said elongated yarn guide member having a convexly curved portion over which said yarn is guided as it is wound on said package for compensating for changes in length of the yarn between said source and said package;

an elongated holder spaced from said elongated yarn guide member;

resilient means interposed between said elongated holder and said elongated yarn guide member permitting said yarn guide member to be moved transversely to the direction of travel of said yarn as a result of changes in the tension in said yarn;

said resilient means including:

(i) an elongated leaf spring means;

(ii) means for connecting one side of said elongated leaf spring means to said yarn guide member;

(iii) means for connecting an opposite side of said leaf spring means to said elongated holder so that said leaf spring means expands and constracts responsive to changes in tension in said yarn; and (iv) said elongated yarn guide member, said elongated holder and said elongated leaf spring means all being elongated in the same direction;

whereby said device compensates for changes in tension occurring during the winding of yarn on said package resulting from stresses due to changes in the length of said yarn extending between said source and said package and changes in tension during winding resulting from other stresses.

2. A device for guiding yarn as it is wound on a package from a source at a constant speed comprising:

an elongated yarn guide member over which said yarn passes as it is fed from said source to said package;

said elongated yarn guide member having a convexly curved portion over which said yarn is guided as it is wound on said package for compensating for changes in length of the yarn between said source and said package;

an elongated holder spaced from said elongated yarn guide member;

resilient leaf spring means interposed between said elongated holder and said elongated yarn guide member permitting said yarn guide member to be moved transversely to the direction of travel of said yarn as a result of changes in the tension in said yarn;

said resilient leaf spring means includes:

(i) four arms;

(ii) a first pair of said arms having inner portions connected to said elongated holder;

(iii) a second pair of said arms having inner portions connected to said elongated yarn guide member; and (iv) means for connecting portions of said first and second pairs of arms remote from inner portions together so taht said yarn guide member is resiliently supported on said elongated holder;

whereby said device compensates for changes in tension occurring during the winding of yarn on said package resulting from stresses due to changes in the length of said yarn extending between said source and said package and changes in tension during winding resulting from other stresses.

3. A device for guiding yarn as it is wound on a package from a source at a constant speed comprising:

an elongated yarn guide member over which said yarn passes as it is fed from said source to said package;

said elongated yarn guide member having a convexly curved portion over which said yarn is guided as it is wound on said package for compensating for changes in length of the yarn between said source and said package;

an elongated holder spaced from said elongated yarn guide member;

resilient means interposed between said elongated holder and said elongated yarn guide member permitting said yarn guide member to be moved transversely to the direction of travel of said yarn as a result of changes in the tension in said yarn;

said resilient means includes:

(i) an elongated supporting rail connected to said elongated yarn guide member;

(ii) said elongated suporting rail being constructed of flexible material; and (iii) a bar connecting said elongated supporting rail to said elongated holder;

whereby said device compensates for changes in tension occurring during the winding of yarn on said package resulting from stresses due to changes in the length of said yarn extending between said source and said package and changes in tension during winding resulting from other stresses.

4. The device as set forth in claim 3 wherein said supporting rail with said bar and elongated holder is an integral member.

5. The device as set forth in claim 3 wherein said bar is positioned off-center to said elongated supporting rail.

* * * * *